United States Patent [19]

Pelto-Huikko

[11] Patent Number: 5,056,627

[45] Date of Patent: Oct. 15, 1991

[54] HYDRAULIC ELEVATOR

[75] Inventor: Raimo Pelto-Huikko, Vantaa, Finland

[73] Assignee: Kone Elevator GmbH, Baar, Switzerland

[21] Appl. No.: 534,641

[22] Filed: Jun. 7, 1990

[30] Foreign Application Priority Data

Jun. 9, 1989 [FI] Finland ..... 892843

[51] Int. Cl.[5] ..... B66B 9/04

[52] U.S. Cl. ..... 187/20; 187/26; 187/94

[58] Field of Search ..... 787/20, 26, 29.2, 17, 787/23, 94; 254/89 R

[56] References Cited

U.S. PATENT DOCUMENTS

| | | | |
|---|---|---|---|
| 595,874 | 12/1897 | Duwelius | 187/20 |
| 1,419,783 | 6/1922 | Julien | 187/20 X |
| 4,830,146 | 5/1989 | Nakamura et al. | 187/26 |

FOREIGN PATENT DOCUMENTS

| | | |
|---|---|---|
| 530697 | 9/1956 | Canada . |
| 3736769A1 | 5/1989 | Fed. Rep. of Germany . |
| 52-64743 | 5/1977 | Japan . |
| 52-66251 | 6/1977 | Japan . |
| 54-162355 | 12/1979 | Japan . |
| 1496878 | 1/1978 | United Kingdom . |

*Primary Examiner*—Robert P. Olszewski
*Assistant Examiner*—Dean A. Reichard
*Attorney, Agent, or Firm*—Nixon & Vanderhye

[57] ABSTRACT

A hydraulic elevator system of the type having a vertically travelling car includes a hydraulic actuator means disposed on a side of an elevator shaft and a car suspension means. The concentrated car suspension means comprises rope pulleys, a compensating rope and compensator means disposed laterally to the elevator shaft.

5 Claims, 2 Drawing Sheets

HYDRAULIC ELEVATOR

BACKGROUND OF THE INVENTION

1. Field of the Invention

The present invention relates generally to a hydraulic elevator system having an elevator car conveyed along a vertical shaft by hydraulic actuator means in which the hydraulic actuator means are located laterally with respect to the elevator shaft.

More specifically, the invention provides an elevator system with compensative means for balancing while concentrating the elevator car weight, by generating a compensating force corresponding to a specific lifting force.

2. Description of Related Art

In hydraulic elevator systems employing the method of concentrated car suspension in actual use, a single lifting cylinder placed centrally below the elevator car or two laterally lifting cylinders are used. In addition, there are many hydraulic elevator systems which have implemented the concentrated car suspension method by using various rope and balance arrangements. These systems have not been manufactured because of their complexity and high production costs. The systems employing one cylinder placed centrally below the elevator car are too expensive to be carried out because of the "well" required to install the lifting cylinder. In the systems using two cylinders, concentrated car suspension is obtained at high expenses (e.g. for the same lifting power, the expenses for two cylinders are bigger than the expenses for one cylinder). Furthermore, a wider elevator shaft is needed for the two cylinder solution and, additionally, due to the buckling effect, the maximum lifting height is decreased.

For the reasons stated above, most hydraulic elevators in use employ a lateral lifting method despite the high strain on the guide rails due to the unconcentrated car suspension. In these systems, the friction between the guide rails and the elevator car reduces the efficiency of the elevator as well as the travelling comfort. Furthermore, the guide rails have to be substantially heavier than in the case of elevators with concentrated car suspension. Moreover, the guide rails are subject to fast wear.

In order to overcome these problems, some of the hydraulic elevators employing a lateral lifting method in actual use are provided with a compensating rope for obtaining a concentrated car suspension. Thus, the "well" for accommodating the lifting cylinder is eliminated. Additionally, such systems require considerably less components and installation work than the two-cylinder systems. An elevator employing the lateral lifting method and provided with a compensating rope does not require as wide a shaft as needed for accommodating two cylinders placed on opposite sides of the shaft. Moreover, when a single cylinder is used, the frictional force is lower than in the case of two smaller cylinders. A greater effective lifting height is obtained as well.

Swiss patent CH 517,043 discloses a method for implementing concentrated car suspension for a hydraulic elevator employing the lateral lifting principle. In this patent the compensator between the lifting rope and the compensating rope consists of a lever balance hinged on the bottom of the elevator car and provided with rope pulleys at its ends. The lever balance dimensions depend upon the dimensions of the elevator car and thus the resulting device is always quite big (its width is at least equal to that of the car). The state of the balance must be continuously monitored via the car cable, using a suitable sensor or switch.

The teachings of the aforesaid prior art, require that the lifting rope, the compensating rope and the balance with its hinge and pulleys be located in the same plane as the car centre of gravity. However, in the present invention, the lifting rope and the centre of gravity of the car are located in one plane and the compensating rope and its pulleys are located in a plane parallel with the first one. This arrangement provides more freedom at the designing stage thus allowing better constructions to be achieved.

Furthermore, the present invention offers several advantages over the known systems. Since the lever balance is placed below or beside the lifting cylinder, it can be of reduced dimensions (about the size of the lifting rope pulley). In other words, the size of the balance is independent of the size of the elevator car. The pulleys for the compensating rope are mounted directly on the car frame without balances or hinges, thus avoiding an increase in the weight of the car. Since the balance is not mounted on the car but in the elevator shaft, it can be monitored easier (i.e. not via the car cable).

SUMMARY OF THE INVENTION

A main object of the present invention is to provide a concentrated car suspension system for a hydraulic elevator employing the lateral lifting method, eliminating the above mentioned drawbacks.

Accordingly a hydraulic elevator system of the type having a vertically travelling car, hydraulic actuator means placed on a lateral side of the elevator shaft and a concentrated car suspension means wherein said concentrated car suspension means comprises rope pulleys, a compensating rope, and compensator means placed laterally to the elevator shaft, preferably beside or below the hydraulic actuator means is disclosed.

In a preferred embodiment of the invention the lever balance is hinged on a column located below the lifting cylinder. The lifting rope is attached to one end of the lever and the compensating rope is attached to the other end.

In another preferred embodiment of the present invention the lifting and compensating ropes form a single rope and the compensator consists of two balancing pulleys, one of which is rotatably mounted on the elevator car and the other, on a fixed structure in the elevator shaft.

In another preferred embodiment of the present invention the compensator is a hydraulic cylinder having a moving piston which controls the tension of the compensating rope. The fluid circulates via a pipe connecting this cylinder to the hydraulic fluid circuit of the lifting cylinder.

BRIEF DESCRIPTION OF THE DRAWINGS

In the following, the invention is described with the aid of examples representing preferred embodiments, reference being made to the drawings attached, wherein.

DESCRIPTION OF PREFERRED EMBODIMENTS

Figure 1:
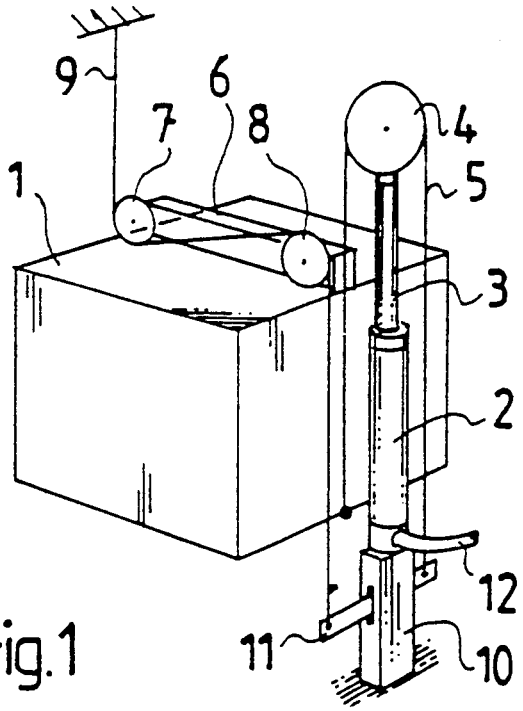
FIG. 1 shows a simplified perspective view of a hydraulic elevator system employing the lateral lifting method, the concentrated car suspension arrangement and the compensating means as provided by a preferred embodiment of the present invention.

In FIG. 1, the elevator car 1 is moved vertically by a hydraulic actuator, e.g. a lifting cylinder 2. The lifting force is applied to the lateral side of the elevator car. The lifting cylinder 2 is supplied with hydraulic fluid via a hose 12. A diverter pulley 4 is rotatably mounted to the free end of the piston 3 of the cylinder. The lifting rope 5, made of several parallel ropes (not shown in FIG. 1 in order to simplify the drawings) passes around the diverter pulley 4. One end (subsequently named the first end) of the lifting rope is attached to the lateral side of the elevator car 1. To obtain a concentrated car suspension, the elevator car is provided with a beam 6 transversely placed on its roof. Two diverted pulleys 7, 8 are mounted close to each beam end. The compensating rope 9, made of several parallel ropes, (not shown on FIG. 1 in order to simplify the drawings), engages the pulleys 7 and 8. One end (subsequently named the first end) of the compensating rope is fixed to a suitable structure above the elevator shaft on the opposite side with respect to the side where the lifting cylinder is located. From this point, the compensating rope runs downwards, engaging diverter pulley 7 on its lower side, runs horizontally and engages diverter pulley 8 on its upper side, and further runs downwards to the lever balance 11, where the second end of the compensating rope is fixed to the second end of the lever. The other end (subsequently named the second end) of the lifting rope 5 is attached to the first end of the lever balance. The lever balance is hinged on the column 10 which sustains the lifting cylinder. It compares the force in the compensating rope to the force in the lifting rope, the ratio being generally $\frac{1}{2}$. This is achieved by using a balance with 2:1 leverage. However, depending on the position of the supporting diverter pulleys 7 and 8 on the beam 6, the leverage of the balance can be changed so as to obtain a concentrated car suspension for a particular embodiment. The lever balance can also be placed beside the lifting cylinder or in any structurally suitable place. One of the main advantages of this invention is that the lever-balance resulting size is small.

Figure 2:
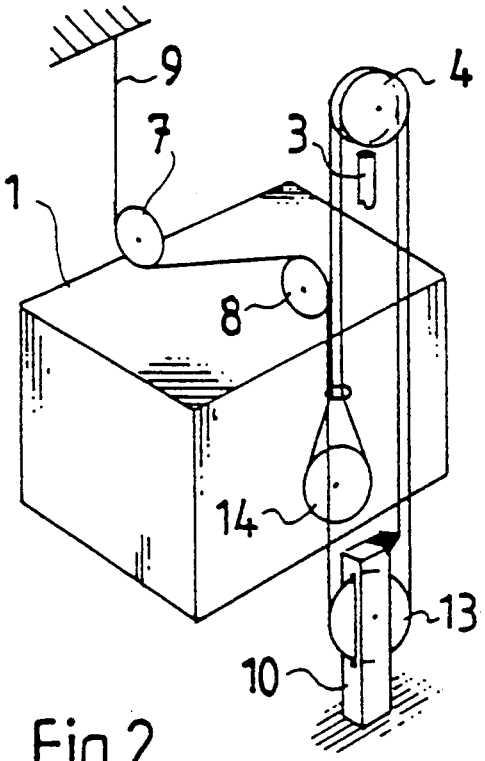
FIG. 2 shows a hydraulic elevator system with a different compensating means according to a second preferred embodiment of the present invention.

It is also possible to implement the compensation by using balancing pulleys instead of a lever balance as illustrated in FIG. 2. In this case the compensating rope 9 is used for both lifting and compensation. This solution reduces the number of rope attachment points as well as the involved monitoring. In this embodiment, the compensating rope 9 (=lifting rope) engages the diverter pulley 7 on it lower side, and the diverter pulley 8 on its upper side, runs downwards and engages the balancing pulley 13, then runs upwards and engages the diverter pulley 4, runs downwards again and engages the other balancing pulley 14, further runs upwards and engages the diverter pulley 4 for the second time, ending up in an attachment on the column 10. Balancing pulley 14 moves along with the elevator car 1. The diverter pulley 4 is supported by the piston 3 of the lifting cylinder as in the embodiment of FIG. 1.

Figure 3:
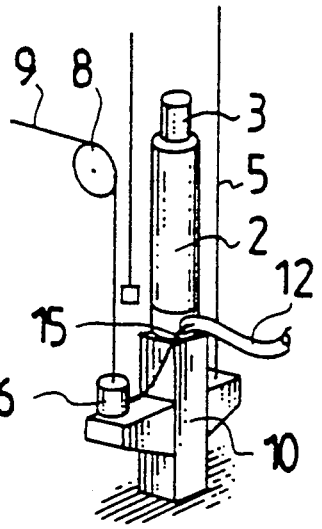
FIG. 3 illustrates a hydraulic elevator system with a different compensating means according to a third preferred embodiment of the present invention.

FIG. 3 illustrates another compensating arrangement in which the lever balance has been replaced with a hydraulic cylinder 16 tensioning the compensating rope 9. The fluid supply hose for the lifting cylinder 2 is connected with the cylinder 16 via a pipe 15. As this solution is similar to that shown in FIG. 1, some items are not represented on FIG. 3. This embodiment provides considerable advantages because, as stated before, there are in practice at least two compensating parallel ropes used and the force in the compensating rope has to be distributed among them in a controlled way. Hydraulic compensation solves this problem if a rope-specific tensioning cylinder is used.

Figure 4:
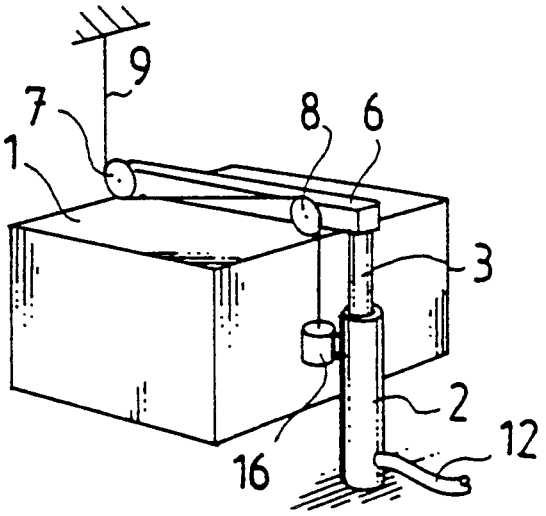
FIG. 4 shows a hydraulic elevator system with a different compensating means according to a fourth preferred embodiment of the present invention.

FIG. 4 shows another embodiment where the piston 3 of the lifting cylinder 2 is connected directly to the beam 6 attached to the top of the elevator car 1. The compensator is a hydraulic cylinder 16 which controls the tension of the compensating rope. The hydraulic fluid space of the tensioning cylinder 16 communicates with the fluid space of the lifting cylinder 2.

The other embodiments, one or both of the balancing pulleys shown in FIG. 2 may be replaced with lever balances, in which case the supporting forces can be changed when necessary.

It is obvious to a person skilled in the art that the invention is not restricted to the embodiments described above, and that they may be varied within the scope of the following claims.

I claim:

1. A hydraulic elevator system comprising:

an elevator car for travelling vertically in an elevator shaft;

hydraulic actuator means, comprising a lifting cylinder having a movable piston, said actuator means being located in the elevator shaft, proximal to one lateral side of said elevator car;

a transversely extending beam fixed substantially in the middle of said elevator car roof, first and second rope pulleys rotatably supported by said beam and a compensating rope accommodated by said pulleys;

compensator means, mounted beside or below said hydraulic actuating means;

a diverting pulley carried by said movable piston;

a lifting rope having a first end fixed to said lateral side of the elevator car and a second end to said compensator means, said lifting rope engaging said diverting pulley, said compensating rope having a first end fixed to a fixed structure in the elevator shaft above and on the side opposite to said lateral side of the elevator car, and having a second end fixed to the compensator means, said compensating rope passing under the first pulley and above the second pulley.

2. A system as claimed in claim 1, wherein said compensator means comprise a lever balance with a balance lever pivotal on a column, the second end of said lifting rope being fixed to a first end of said balance lever and a second end of said compensating rope being fixed to a second end of said balance lever.

3. A system as claimed in claim 1, wherein the compensator means comprise a first pulley rotatably mounted on a column and a second pulley rotatably mounted on said lateral side of the elevator car and wherein said compensating rope and said lifting rope constitute a single rope.

4. A system as claimed in claim 1, wherein said compensator means comprises a column and a second hydraulic cylinder for controlling the tension of said compensating rope and mounted on said column, the second end of said compensating rope being fixed to a movable piston of said second hydraulic cylinder, said second end of said lifting rope being fixed to said column, said second hydraulic cylinder being connected by a pipe to the hydraulic circuit of said hydraulic actuator means.

5. A hydraulic elevator system comprising:

an elevator car for travelling vertically in an elevator shaft;

hydraulic actuator means, comprising a lifting cylinder having a movable piston, said actuator means being located in the elevator shaft, proximal to one lateral side of said elevator car;

a transversely extending beam fixed substantially in the middle of said elevator car roof, first and second rope pulleys rotatably supported by said beam and a compensating rope accommodated by said pulleys;

compensator means, mounted beside or below said hydraulic actuating means;

said compensating rope having a first end fixed to a fixed structure in the elevator shaft above and on the side opposite to said lateral side of the elevator car, and having a second end fixed to the compensator means, said compensating rope passing under the first pulley and above the second pulley; and said movable piston of said lifting cylinder being fixed to said transverse beam, and said compensator means comprising a second hydraulic cylinder mounted on a column for controlling the tension of said compensating rope, the second end of said compensating rope being fixed to the movable piston of said second hydraulic cylinder, said second hydraulic cylinder being connected by a pipe to the hydraulic circuit of said hydraulic actuator means.

* * * * *